United States Patent [19]

Hofer

[11] Patent Number: 4,757,794

[45] Date of Patent: Jul. 19, 1988

[54] INJECTION SYSTEM FOR A VALVE OF A DIESEL ENGINE

[75] Inventor: Robert Hofer, Elgg, Switzerland

[73] Assignee: Sulzer Brothers Limited, Winterthur, Switzerland

[21] Appl. No.: 724,174

[22] Filed: Apr. 17, 1985

[30] Foreign Application Priority Data

Feb. 28, 1985 [CH] Switzerland ..... 00904/85

[51] Int. Cl.[4] ..... F02M 39/00

[52] U.S. Cl. ..... 123/506; 123/501; 123/447; 417/494

[58] Field of Search ..... 123/506, 500, 501, 496, 123/447; 417/494, 499

[56] References Cited

U.S. PATENT DOCUMENTS

| | | | |
|---|---|---|---|
| 1,966,694 | 7/1934 | Vaudet | 123/501 |
| 2,195,946 | 4/1940 | Occusic | 417/494 |
| 2,474,396 | 6/1949 | Groves | 417/494 |
| 3,930,482 | 1/1976 | Akashi | 417/499 |
| 4,064,855 | 12/1977 | Johnson | 123/506 |

FOREIGN PATENT DOCUMENTS

| | | | |
|---|---|---|---|
| 1011148 | 6/1952 | France | 123/501 |
| 351112 | 6/1930 | United Kingdom | 123/501 |
| 370678 | 4/1932 | United Kingdom | 123/501 |

*Primary Examiner*—Carl Stuart Miller

*Attorney, Agent, or Firm*—Kenyon & Kenyon

[57] ABSTRACT

The valve needle of the injection valve is actuated by a control pressure created by a hydraulic injection system. The control pressure is created by a piston pump and is supplied via a control line to the injection valve. At the beginning of the stroke, a bypass flow path is open with a cross section which decreases continuously with progressing piston stroke. With the aid of the pressure medium volume flowing out through the bypass flow path and decreasing in the course of the stroke, a control pressure which is free from pressure waves and their reflections in the control line and which continuously approaches a desired value is created and supplied through the control line to the valve needle without pressure fluctuations causing an oscillating opening and closing of the needle.

4 Claims, 2 Drawing Sheets

INJECTION SYSTEM FOR A VALVE OF A DIESEL ENGINE

This invention relates to an injection system for a valve of a diesel engine. More particularly, this invention relates to an injection system for a time controlled and hydraulically operated injection valve of a diesel engine.

As is known, diesel engines have frequently been provided with injection valves which are hydraulically operated and time controlled for the injection of fuel. Generally, the injection valves have been constructed with a valve seat, a valve needle which seats on the seat and a valve chamber adjacent the seat for injecting fuel when the valve needle is raised from the valve seat. In addition, it has been known to provide the valve needle with a piston which, in turn, is disposed within a cylinder which receives a pressure medium. When the pressure medium is pressurized, the cylinder is moved so as to move the valve needle from the valve seat so that fuel may be injected. Generally, the cylinder chamber is pressurized via a control line by means of a control pump which is actuated in dependence on the speed of rotation of the engine. In this regard, the control pump has a piston which serves to create a control pressure in the control line to the injection valve.

An injection system as described above, is known from German Patent No. 1281207. In this system, the control pump which is in the form of a piston pump having a stroke controlled by a cam shaft creates a hydraulic control pressure in a control line by which the valve needle of the injection valve is lifted off the valve seat and held in an open position. In this system, the moment of injection, that is, the beginning and the duration of injection, are variable within certain limits. However, the finite length of the control line causes a finite transit time of the pressure shock created by the control pump. Due to the compressibility of the hydraulic fluid at pressure variations which amount to at least several hundred bars, the shock propagates as a "compressed" volume. This compression volume may be a multiple of the stroke volume (working volume) which is charged during the stroke of the valve needle.

As is known, a pressure shock is reflected at the end of the control line and runs back again in the line. Thus, pressure waves result in the hydraulic system which become manifest as disturbances in the signal transmission of the hydraulic control system. Generally, the transit time of the pressure waves is shorter than the injection period. Thus, the control piston must pump for a longer time than would correspond to the transit time of the pressure wave for an outbound and return travel in the control line. This may, in turn, cause pressures, especially at the end of the control line, which correspond to about double the control pressure required for stroke of the valve needle. This is, of course, undesirable for reasons of material.

Further, pressure created by the piston of the control pump is proportional to the rotational speed of the internal combustion engine (shock wave theory). As a result, at low rotational speeds, the control pressure required for a stroke of the valve needle may not be reached at first. Instead, the control pressure might only be achieved at the second pressure shock. In such cases, irregularities would be caused in the operation of the engine.

It has been found that the irregularities and pressure fluctuations in the control line can be eliminated if the volume stream of the "compression volume" created by the control piston is increased from the value zero to a certain value, at least almost within the pressure wave transit time, and is then keep constant. This forceably brings about a linear pressure increase in the control line. The simplest method to achieve this is to vary the speed of the control piston during the "build-up" phase of the volume stream. However, this method is not feasible for the injection valve of the diesel engine since a constant speed of the control piston is required during the control stroke for a variable beginning of the injection.

Accordingly, it is an object of the invention to eliminate pressure fluctuations and irregularities in the pressure pattern of a control line to an injection valve without the need to vary the speed of a control piston during a compression stroke for the control medium.

It is another object of the invention to provide a relatively simple injection system for opening an injection valve of a diesel engine.

It is another object of the invention to provide a relatively simple injection system to eliminate irregularities in the control pressure delivered to an injection valve for opening of the valve.

Briefly, the invention provides an injection system for a hyraulically operated and time controlled injection valve of a diesel engine. This system is comprised of a control line for conveying a pressure medium to the injection valve, a control pump having a cylinder chamber communicating with the control line and a movable piston for pressurizing the pressure medium in the cylinder chamber and means defining a bypass flow path from the cylinder chamber for receiving a partial return of the pressure medium from the control line. In addition, the bypass flow path is provided with a cross section which decreases as the piston moves over a given piston stroke into the cylinder chamber.

In use, at the beginning of a control stroke, practically the entire volume displaced by the control piston flows out via the bypass flow path. Thus, starting at zero, a pressure increase occurs in the control line with the continued stroke of the control piston and with a continuous size reduction of the cross section in the bypass flow path. This pressure increase continues continuously until the desired control pressure is reached. Thereafter, by a suitably controlled intervention, a pressure relief may occur in the control pump while a minimum required control pressure is then retained in the control line until the end of the injection period. As soon as the bypass flow path is closed, the pressure increase occurs independently of the rotational speed of the engine approximately proportional (shock wave free case) to the crank angle of the internal combustion engine, that is, approximately proportional to the path travelled by the control piston.

The means for defining the bypass flow path may include at least one groove in the circumferential periphery of the piston at the end facing the cylindrical chamber. For reasons of symmetry and equilibrium, it is advantageous to provide two diametrically opposed return flow grooves. Furthermore, for a linear pressure increase, the cross section of each bypass flow path should decrease at least approximately parabolically. This requirement can appropriately be realized by making the return flow grooves V-shaped. Alternatively, the grooves may be provided with parallel side walls and with a parabolic bottom or may be in the form of a cylindrical recess at the free piston end. Further, it is possible to arrange the grooves in the wall of the cylinder surrounding the piston.

The period of time during which the bypass flow path is open is determined by the length of the control line. During this time, the necessary control pressure must have passed through the control line forward and back once. This transit time, as is known, is a parameter that can be calculated from the length of the control line, the velocity of sound in the pressure medium, and the density thereof. From this time requirement, a condition is obtained for the permissible length of the return flow grooves in the stroke direction of the control piston. The grooves may be between 1/5 and ¾ of the piston stroke.

After the control pressure necessary for a valve opening operation has been reached, plus a safety margin, the cylinder chamber of the control piston is relieved through a relief connection to the low-pressure side of the control pump. At the same time, the control pressure line is closed by a check valve and is thus kept under pressure. The control line then acts as a pressure accumulator and thereby covers the leakage losses at the needle and relief valve. However, as the control pressure must be maintained to the end of the injection; the pressure must therefore be taken so high that even for the longest injection period, the leakage losses cannot bring about a closing of the valve needle. Without this cylinder relief, the control pressure would rise to impermissibly high values. The injection period is ended by a relief valve in the control line.

These and other objects and advantages of the invention will become more apparent from the following detailed description taken in conjunction with the accompanying drawings wherein:

FIG. 1 schematically illustrates an injection system for an injection valve in accordance with the invention;

FIG. 2 illustrates a view taken on line II—II of FIG. 1; and

Figure 1:
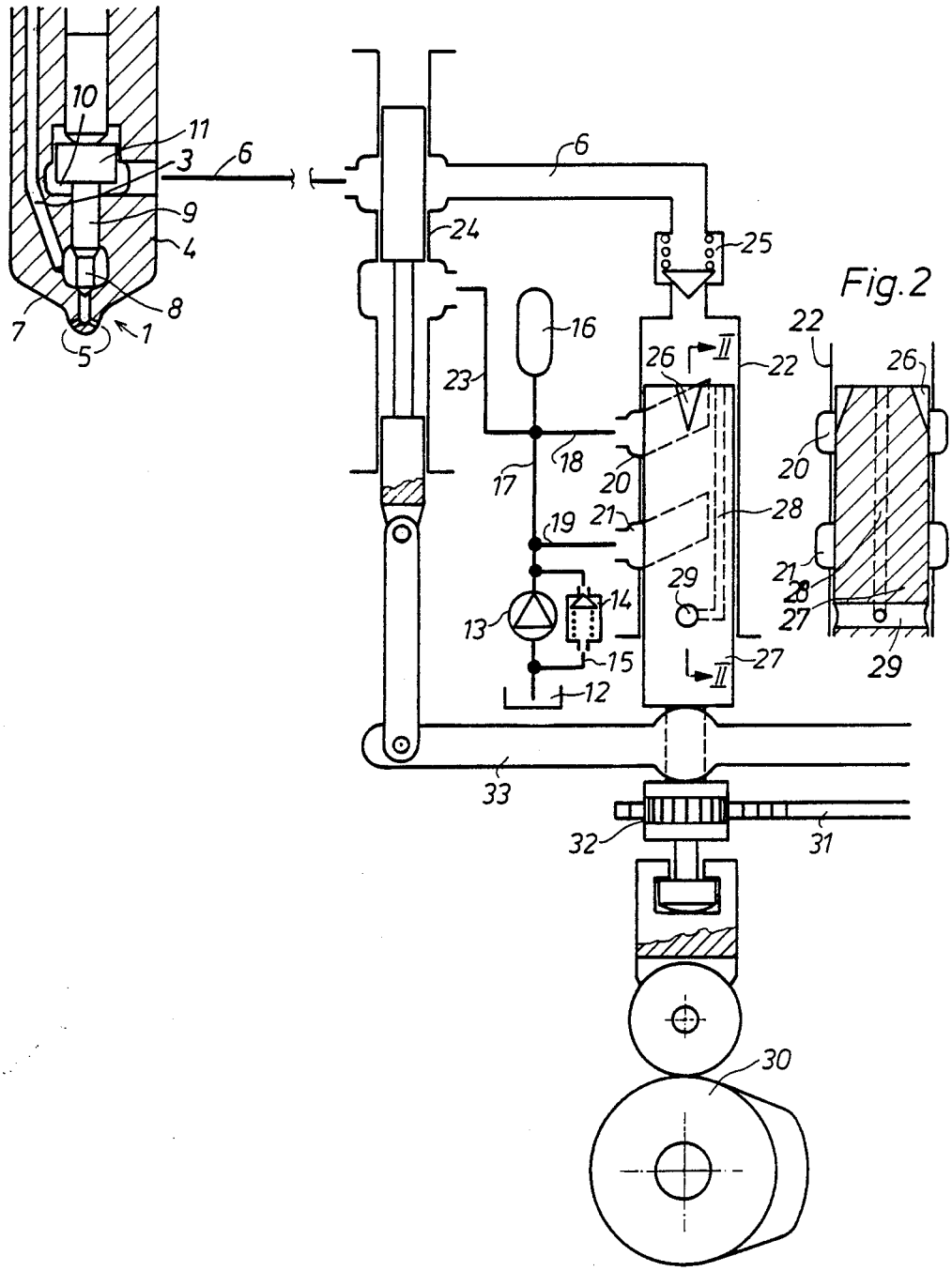

Referring to FIG. 1, the injection valve 1 for a diesel engine (not shown) includes a feed line 3 in a housing part 4 which can be supplied with fuel from a suitable source, such as a fuel pump (not shown) and/or with a fuel reservoir. In this respect, the supply of fuel is a pressure of, for example, 1000 bars. In addition, the housing part 4 contains a plurality of injection nozzles 5 about a central longitudinal axis as well as a valve seat 7 which is disposed before the nozzles 5. This valve seat 7 cooperates with a valve needle 8 which is adapted to seat on the valve seat 5. As indicated, the valve needle 8 is guided under seal in a bore 9 of the housing part 4 and is followed by a cylinder chamber 10. A valve piston 11 is also secured to the needle 8 and is received within the valve chamber 10.

An injection system is associated with the injection valve in order to deliver pressurized medium to the valve chamber 10 in order to move the piston 11 and, thus, the valve needle 8 away from the valve seat 7. To this end, the injection system includes a piston or control pump 22 which is connected via a control line 6 to the valve chamber 10 in order to deliver the pressure medium thereto which triggers, and maintains the injection of fuel into the combustion room of the engine cylinder through the injection valve 1.

The injection system also includes a storage vessel or reservoir 12 for a hydraulic pressure medium and a low pressure pump 13 which is regulated by a regulator 14 via a line 15 so as to deliver the pressure medium at a predetermined delivery pressure into a reservoir 16 via a pressure line 17. In addition, a pair of lines 18, 19 branch off from the pressure line 17 and lead to control openings 20, 21, respectively in a cylinder jacket 39 of the piston or control pump 22 while a return line 23 connects a relief valve 24 in the control line 6 to the reservoir 16 or to the pressure line 17. The hydraulic control circuit also has a check valve 25 in the flow between the control line 6 and a cylinder chamber of the control pump 22 and is filled with a hydraulic pressure medium.

The control pump 22 includes a movable piston 27 for pressurizing the pressure medium in the cylinder chamber. In addition, a means is provided to define a bypass flow path from the cylinder chamber for receiving a partial return of the pressure medium from the control line 6. For example, the means is in the form of a pair of grooves 26 which are located in the circumferential periphery of the piston 27 at the end facing the cylinder chamber. As indicated in FIG. 2, the grooves are disposed in diametric opposition to each other and each communicates with a separate control opening 20, each of which extends circumferentially of the jacket 39 and communicates with the branch line 18. In like manner, a pair of control openings 21 are also provided to communicate with the branch line 19. The control openings 20, 21 are each arranged in diametric fashion so as to provide a symmetrical arrangement. The advantage of the symmetrical arrangement of the control openings 20, 21 and the grooves 26 is such that the hydraulic forces are balanced in the radial direction. Hence, jamming of the piston 27 is prevented.

Referring to FIGS. 1 and 2, each groove 26 has a cross sectional area which decreases in a direction away from the free piston end. For example, each groove is of V-shape so as to decrease at least parabolically in the direction away from the piston end. In addition, the length of each groove is equal to about 1/5 to ¾ of the piston stroke.

Referring to FIGS. 1 and 2, the piston 27 contains a longitudinal passageway or bore 28 which connects with a cross bore 29 so as to communicate the cylinder chamber with the second control opening 21 at the end of the stroke of the piston in order to relieve the pressure in the cylinder chamber.

The relief valve 24 and control pump 22 are controlled primarily by a cam shaft 30 which is coupled with a crank shaft (not shown) of the engine. In a known manner, the piston 27 is rotatable so as to be capable of changing the start of injection as a function of the engine regulator or governor (not shown), for example, with the aid of a rack 31 and pinion 32. These changes in the start of injection can be influenced by the load or the rotational speed of the engine and/or the injection pressure. Coupled with the stroke of the control pump 22, the stroke of the relief valve 24 by which the end of injection and, hence, the injection period is determined, is likewise connected with the engine regulator via a linkage 33 and can therefore be influenced by the same parameters as the start of injection.

The control of the injection process from the beginning and the duration is known per se and is described, for example, in German Patent No. 1751200.

The mode of operation of the injection system is explained with reference to FIG. 3 which represents a development of the cylinder jacket 39 (solid lines) and of the piston surface (dash-dot lines) of the control pump 22.

In a known injection system, the stroke of the piston 27 would take place at a constant speed at least in the control zone so that the volume stream sets in abruptly as soon as the upper edge 35 of the piston 27 closes the control edges 36 of the two control openings 20. This, however, causes pressure waves in the control line 6 due to the sudden pressure shock.

In accordance with the invention, the grooves 26 which are of lesser circumferential extent than the control openings 20 will at first return the entire volume of pressure medium displaced by the piston 27 completely into the control openings 20. As the piston 27 continues to move on, the cross section 37 of the opening of the groove 26 becomes smaller. Thus, starting at zero, a volume stream sets in which is steadily and largely linear and reaches an end value when the tips of the grooves 26 exceed the respective edges 36 of the control openings 20. From this moment on, the further pressure increases occur at constant volume stream approximately proportional with the movement of the piston. This pressure increase continues until the openings 29 pass beyond the lower control edges 38 of the control openings 21. At this time, a return path for the pressure medium from the cylinder chamber of the pump 22 is opened via the longitudinal bore 28 and cross bores 29 into the branch line 19 and, thence, the line 17. In this way, the control pressure can be limited to an admissible value.

Upon relief of the cylinder chamber, the check valve 25 closes and maintains the control pressure in the control line 6 until the relief valve 24 opens.

Figure 3:
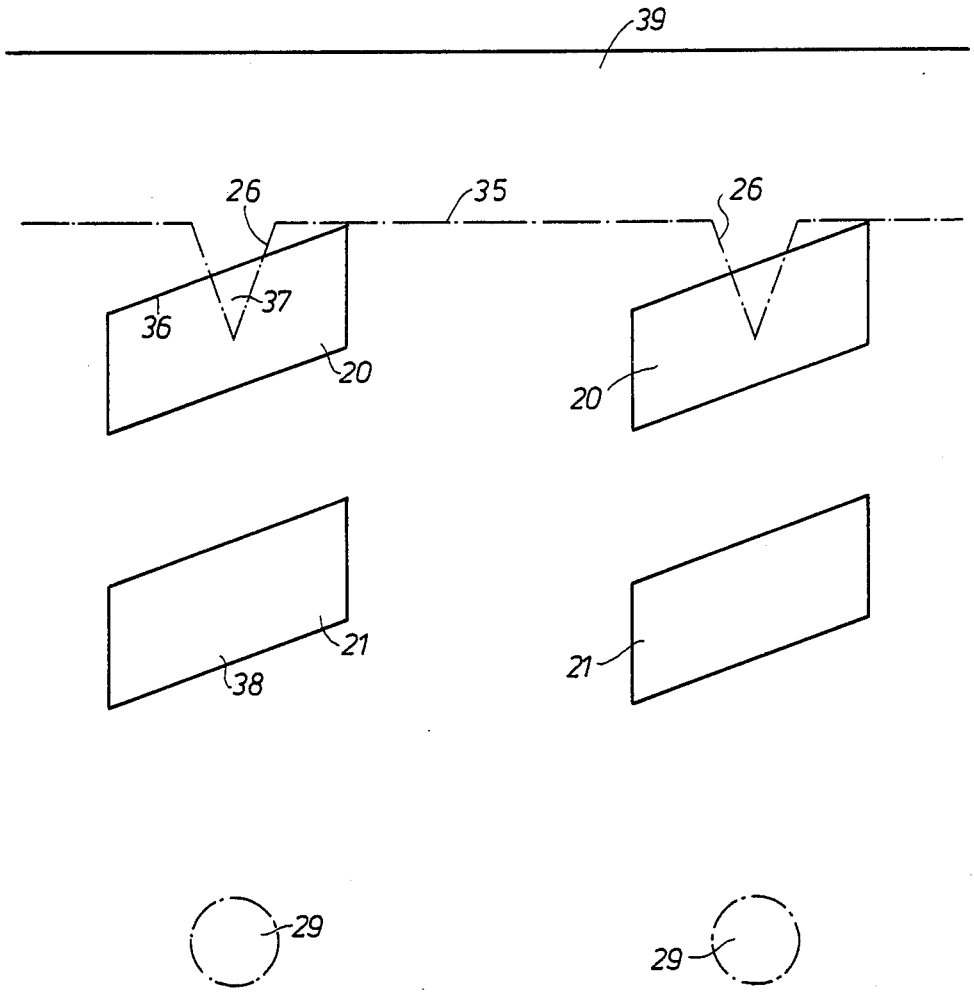
FIG. 3 illustrates a development of the cylinder and piston of the control pump of the injection system of FIG. 1.

As indicated in FIG. 3, a change in the start of injection may be effected by a horizontal relative displacement of the grooves 26 relative to the control edges 36. In this case, advancing the start of injection corresponds to a displacement of the grooves 26 to the left and vice versa.

In a normal cycle of the injection system, with the piston 27 in a bottom position, as viewed, pressure medium is supplied via the pump 13 and branch line 18 through the control openings 20. As the piston 27 is caused to rise, the upper edge 35 of the piston 27 passes by the upper control edge 36 of each control openings 20. The pressure medium in the cylinder chamber of the pump 22 is thereafter pressurized. However, at this time, the grooves 26 are still in communication with the control openings 20. Hence, the pressure medium is displaced by the piston 27 into the control openings 20.

As the piston 27 continues to move upwardly, the cross sectional area of the grooves 26 which is open to the control openings 20 decreases.

During the time that the grooves 26 still communicate with the control openings 20, the pressure in the cylinder chamber of the pump 22 causes the check valve 25 to open so that the pressure in the control line 6 is increased so that the piston 11 can be raised in the injection valve 1 in order to unseat the needle 8. During this time, a return pressure wave can be compensated by the bypass flow paths provided by the grooves 26 into the control openings 20.

As soon as the grooves 26 pass beyond the upper control edges 36 of the respective control openings 20, the bypass flow paths are closed and any further pressure increases caused by the piston 27 occur in approximate proportion to the continued movement of the piston 27.

The invention thus provides a relatively simple technique of eliminating pressure fluctuations and irregularities in the pressure pattern of the control line without the need to vary the speed of the control piston 27 during the compression stroke.

The invention further provides a relatively simple structure which can be incorporated into existing injection systems in order to control the pressure of a control medium to a hydraulically times injection valve.

What is claimed:

1. An injection system for a hydraulically operated and time controlled injection valve of a diesel engine, said system comprising a control line for conveying a pressure medium to the injection valve;

a control pump having a jacket defining a cylinder chamber communicating with said control line and having a control opening for passage of pressure medium into said chamber and a movable piston for pressurizing the pressure medium in said cylinder chamber; and means defining a bypass flow path from said cylinder chamber for receiving a partial return of the pressure medium from said control line, said means including a groove in an end of said piston facing said chamber, said groove being of lesser circumferential extent than said control opening to define a bypass flow path having a cross-section which decreases as said piston moves over a given piston stroke into said cylinder chamber.

2. An injection system for a hydraulically operated and time controlled injection valve of a diesel engine, said engine comprising a control line for conveying a pressure medium to the injection valve; and a control pump having a cylinder jacket defining a chamber communicating with said control line, a control opening in and extending circumferentially of said jacket for passage of pressure medium into said chamber, and a movable piston in said jacket for pressuring the pressure medium in said chamber, said piston having an edge in an end facing said chamber to close over said control opening during a stroke of said piston into said chamber and at least one groove of lesser circumferential extent than said control opening extending from said edge and aligned with said control opening to define a bypass flow path for receiving a partial return of the pressure medium from said control line for delivery to said control opening.

3. In combination, an injection valve for a diesel engine, said valve including a valve seat, a valve needle for seating on said seat, a valve piston secured to said needle and a valve chamber receiving said piston; and an injection system for delivering a pressurized medium to said valve chamber to move said piston and said valve needle away from said seat, said system including a control line connected to said chamber to deliver pressure medium thereto, a control pump having a cylindrical chamber connected to said control line, a control opening for passage of pressure medium into said chamber and a movable piston for pressuring the pressure medium in said cylinder chamber, and means defining a bypass flow path from said cylinder chamber for receiving a partial return of the pressure medium from said control line, said means including at least one groove in the circumferential periphery of said pump piston at an end facing said cylinder chamber to communicate with said control opening to deliver a back flow of pressure medium from said chamber thereto, said groove being of lesser circumferential extent than said control opening and having a cross-section which decreases as said pump piston moves over a given piston stroke into said cylinder chamber.

4. An injection system as set forth in claim 1 wherein said jacket includes a second control opening and said piston includes a bore extending from said end to communicate said chamber with said second control opening at the end of the stroke of said piston.

* * * * *

UNITED STATES PATENT AND TRADEMARK OFFICE

CERTIFICATE OF CORRECTION

PATENT NO. : 4,757,794

DATED : July 19, 1988

INVENTOR(S) : Robert Hofer

It is certified that error appears in the above-identified patent and that said Letters Patent is hereby corrected as shown below:

Column 6, line 12 change "times" to -timed-

Signed and Sealed this

Twenty-ninth Day of November, 1988

*Attest:*

DONALD J. QUIGG

*Attesting Officer*

*Commissioner of Patents and Trademarks*